US007210964B2

(12) United States Patent
Morris et al.

(10) Patent No.: US 7,210,964 B2
(45) Date of Patent: May 1, 2007

(54) ELECTRICAL CONNECTOR BACKSHELL ASSEMBLIES

(75) Inventors: Brian S. Morris, Olathe, KS (US); Scott A. Hoffman, Basehor, KS (US); Robert D. Lanning, Leawood, KS (US)

(73) Assignee: Honeywell International, Inc., Morristown, NJ (US)

( * ) Notice: Subject to any disclaimer, the term of this patent is extended or adjusted under 35 U.S.C. 154(b) by 0 days.

(21) Appl. No.: 11/203,103

(22) Filed: Aug. 15, 2005

(65) Prior Publication Data

US 2007/0037449 A1 Feb. 15, 2007

(51) Int. Cl.
*H01R 9/03* (2006.01)

(52) U.S. Cl. ..... 439/610; 439/471; 439/579

(58) Field of Classification Search ..... 439/610, 439/471, 464, 470, 460, 95, 97, 583, 579, 439/578, 451; 174/74 R, 74 A, 79, 80, 89, 174/84 R, 88 R
See application file for complete search history.

(56) References Cited

U.S. PATENT DOCUMENTS 3,753,203 A * 8/1973 Link ..... 439/95
4,035,051 A * 7/1977 Guy ..... 439/464
5,174,768 A * 12/1992 Hewison et al. ..... 439/95
5,174,769 A * 12/1992 Dearman ..... 439/98
5,681,172 A * 10/1997 Moldenhauer ..... 439/95
5,769,665 A * 6/1998 Neely et al. ..... 439/610

OTHER PUBLICATIONS

Printout of *Glenair*, "Backshells and Circular Connector Accessories Product Selection Guide," from www.glenair.com/backshells/circular/, printed Jun. 12, 2006, pp. 1-5.

* cited by examiner

*Primary Examiner*—Felix O. Figueroa
(74) *Attorney, Agent, or Firm*—Ingrassia Fisher & Lorenz

(57) ABSTRACT

An electrical connector backshell assembly may include at least one cable containing at least one electrical wire that is protected by a shield, at least a portion of the shield being separable from the at least one electrical wire. The backshell assembly also may include a housing defining an opening configured to receive the at least one cable and a termination area electrically coupled to the housing. The separable portion of the shield may be urged into contact with the termination area.

16 Claims, 5 Drawing Sheets

ELECTRICAL CONNECTOR BACKSHELL ASSEMBLIES

TECHNICAL FIELD

The present invention is directed to electrical connector backshell assemblies and, more particularly, to electrical connector backshell assemblies for one or more electrical cables.

BACKGROUND

In some conventional electrical connector backshell assemblies, individual electrical cable shield braid terminations consume large amounts of space inside the connector backshell, thus leaving little room for the signal-carrying wires inside the backshell. Also, individually terminating each of the shield braids consumes large amounts of labor time. However, collectively terminating multiple shield braids that are not carefully organized and dressed may lead to partial or incomplete electrical contact between the shield braids and a termination area.

Thus, it may be desirable to provide electrical connector backshell assemblies having shield braid terminations outside of the connector backshell. It may further be desirable to collectively terminate multiple shield braids. In collectively terminating multiple shield braids, it may be desirable to organize and/or dress the shield braids to maximize electrical contact of the shield braids with the termination area.

Some conventional electrical connector backshell assemblies have an opening for receiving cable bundles having a wide range of diameters. When a bundle does not occupy the entire opening, electrical interference can enter the backshell via the unoccupied portion of the opening.

Therefore, it may be desirable to provide electrical connector backshell assemblies with an adjustably-variable opening that can be customized for any size bundle of cables at the time of cable installation.

The electrical connector backshell assemblies of the present invention solve one or more of the problems set forth above.

SUMMARY OF THE INVENTION

According to various aspects, an electrical connector backshell assembly may comprise a housing, an opening in the housing, and a termination area electrically coupled to the housing. The housing may be configured to receive at least one cable containing at least one electrical wire that is protected by a shield. The shield may be separable from at least one electrical wire. The opening may be configured such that a portion of the shield separated from at least one electrical wire is passable through the opening out of the housing. The termination area may be configured to receive a clamping member. The clamping member may be configured to urge the separated portion of the shield in electrical contact with the termination area.

In accordance with various aspects, an electrical connector backshell assembly may comprise a housing, and a cover member coupled to the housing. The housing may have a variable-sized opening configured to accommodate a width of at least one cable containing at least one electrical wire. The connection portion may be configured to be electrically coupled with at least one electrical wire and to define an electrical interface to at least one electrical wire. The cover member may be configured to vary the size of the opening to minimize a portion of the opening that is not occupied by at least one cable.

DETAILED DESCRIPTION

Figure 1:
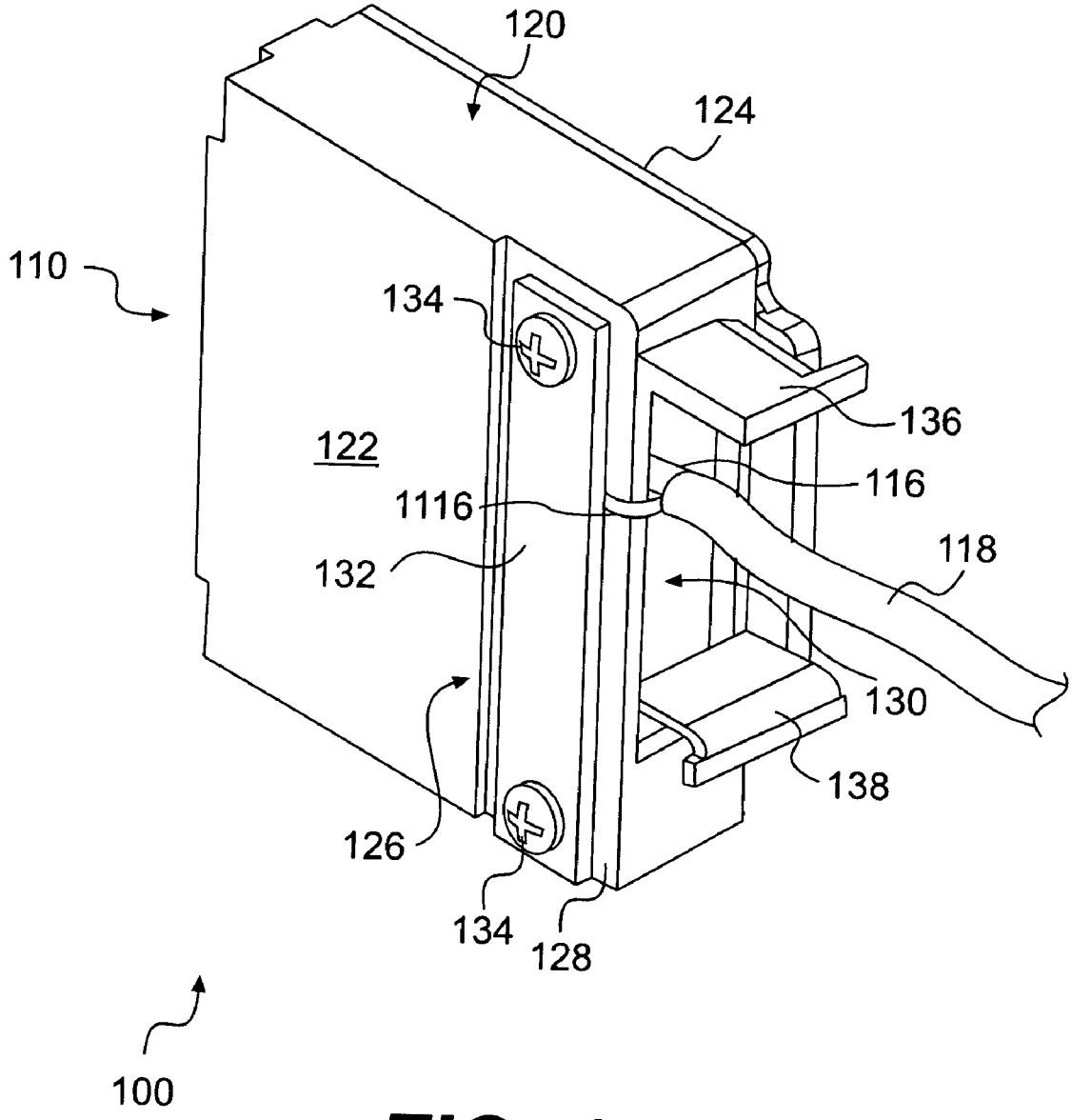
FIG. 1 is a bottom perspective view of an exemplary electrical connector backshell assembly with an attached cable in accordance with various aspects of the disclosure.
Figure 2:
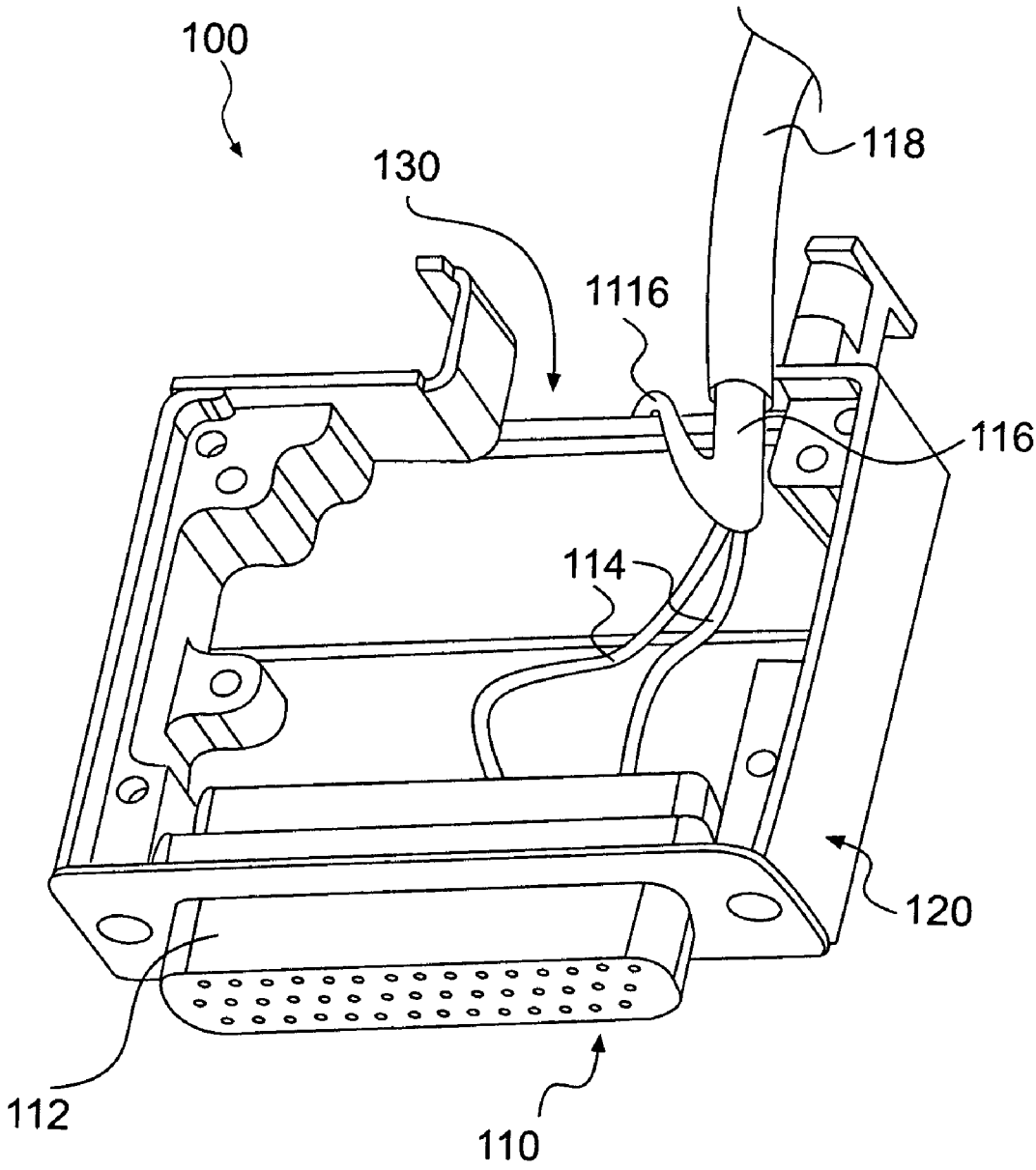
FIG. 2 is a top perspective view of the electrical connector backshell assembly and cable of FIG. 1 with a cover removed.

An exemplary embodiment of an electrical connector backshell assembly 100 is illustrated in FIGS. 1 and 2. The electrical connector backshell assembly 100 may include a connection portion 110 and a housing 120. The housing 120 may be of various sizes to accommodate various sized electrical connectors. As shown in FIG. 2, the connection portion 110 may comprise a multi-receptacle connector 112 configured to be mated with a complementary multi-pin connector (not shown). The connector 112 may define an electrical interface to at least one electrical wire 114.

The housing 120 may comprise a first portion 122, for example, a backshell, and a second portion 124, for example, a cover. The second portion 124 may be removably attachable to the first portion 122 via fasteners such as screws or the like (not shown). The first portion 122 may also include a termination area 126. Although FIG. 1 depicts the termination area 126 on an exterior surface 128 of the first portion 122, one skilled in the art would understand that the termination area 126 may be on an exterior surface of the second portion 124.

The housing 120, including the termination area 126, may comprise any conductive material such as, for example, an aluminum, zinc, steel, or other metal alloy with a plating of nickel, tin, chromate conversion, or the like. According to one exemplary aspect, the housing 120 and termination area 126 may comprise an aluminum alloy with nickel plating. According to some aspects, the housing 120 and termination area 126 may comprise a conductive plastic.

The housing 120 may comprise an opening 130 configured to receive at least one cable 118. The cable 118 may contain at least one electrical wire 114, which is protected by a shield 116. As shown in FIG. 2, the cable 118 may pass through the opening 130 to facilitate connection of the at least one electrical wire 114 to the connection portion 110. A portion 1116 of the shield 116 may be separable from the at least one electrical wire 114. The separated portion 1116 of the shield 116 may be routed back out of the opening 130 and to the termination area 126. According to various aspects, the separated portion 1116 may be twisted into a pigtail to provide a more orderly appearance.

The electrical connector backshell assembly 100 may further include a clamping member 132. According to various aspects, the clamping member 132 may comprise, for example, a plate. The clamping member 132 may be configured to urge the separated portion 1116 of the shield 116 in electrical contact with the termination area 126. For example, the clamping member 132 may be coupled to the housing 120 with one or more fasteners 134. The one or more fasteners 134 may comprise any screw or the like known in the art.

The termination area 126 can have a variable surface or a flat surface. It should be appreciated that a variable surface termination area may cooperate with the clamping member 132 to provide a better grip on the separated portions 1116 of the shield 116, which may thus provide better electrical contact.

The electrical connector backshell assembly 100 may also include one or more strain relief members 136, 138 configured to relieve strain on the at least one cable 118 terminated at the electrical connector 100. The strain relief members 136, 138 may be of unitary construction with the first portion 122 or may be separate from the first portion 122 and subsequently coupled with the first portion 122 via assembly.

Figure 3:
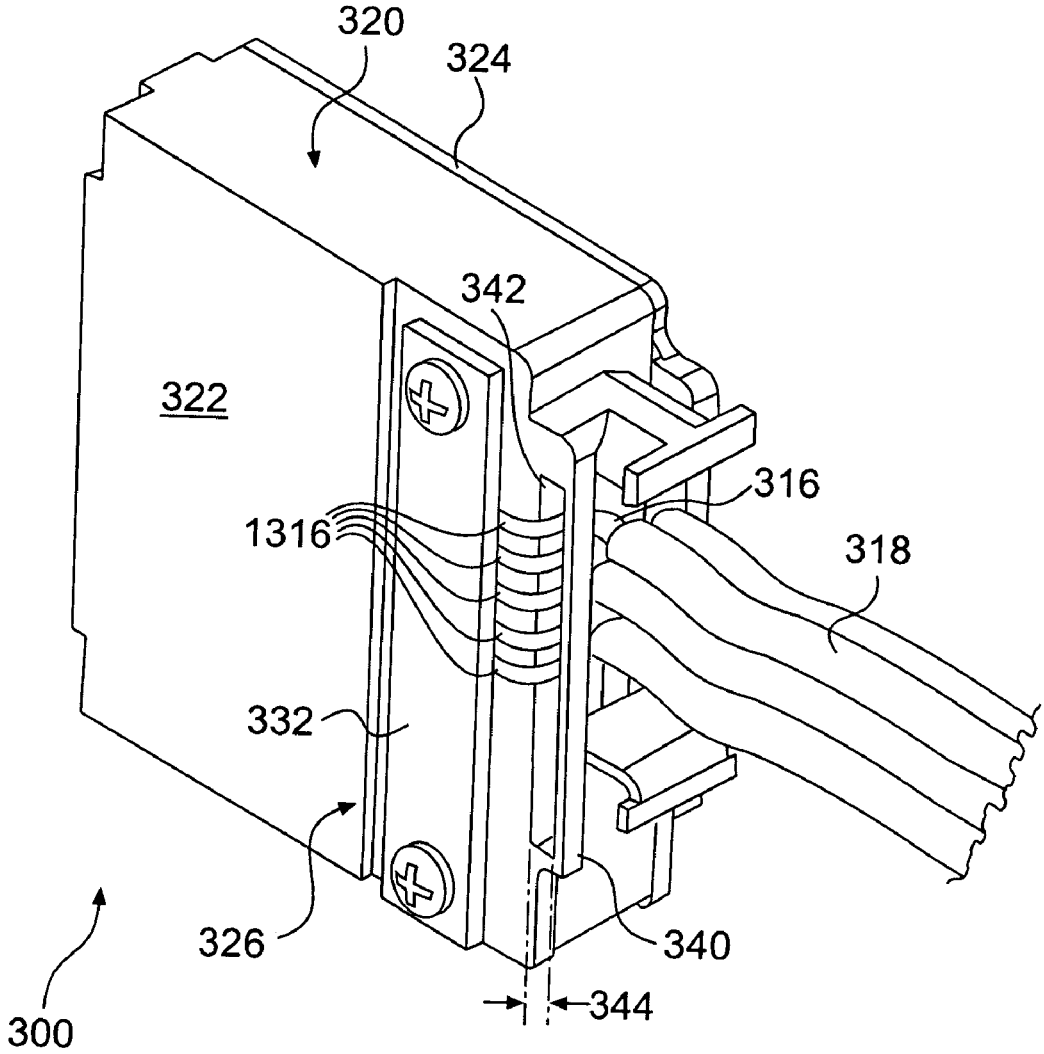
FIG. 3 is a bottom perspective view of another exemplary electrical connector backshell assembly with a plurality of attached cables in accordance with various aspects of the disclosure.

Referring now to FIG. 3, an exemplary electrical connector backshell assembly 300 may comprise a housing 320, a termination area 326, and a clamping member 332, similar to the connector 100 described above. According to various aspects, the housing 320 may include an extension 340 extending from a first portion 322 of the housing 320. The extension 340 may include an elongated slot 342 configured to receive one or more separated portions 1316 of shield braids 316 from one or more cables 318. It should be appreciated that, in some embodiments, the extension and slot may extend from a second portion 324 of the housing 320.

According to various aspects, the elongated slot 342 may have a width 344 sized greater than the width of a single separated portion 1316 of a shield braid 316, but less than a combined width of any two separated portions 1316. Consequently, when a plurality of separated portions 1316 are fed through the slot 342, the width 344 of the slot 342 dictates that the separated portions 1316 pass through the slot 342 in a side-by-side manner without overlapping. The separated portions 1316 thus exit the slot 342 in a side-by-side arrangement, which facilitates a similar side-by-side arrangement of the separated portions 1316 at the termination area 326. The clamping member 332 may clamp the separated portions 1316 to the termination area 326 in a substantially side-by-side arrangement, thus maximizing electrical contact between the separated portions 1316 and the termination area 326. It should be appreciated that the width of the single separated portion 1316 may comprise, for example, a diameter of a pigtailed portion having a substantially round cross-section.

Figure 4:
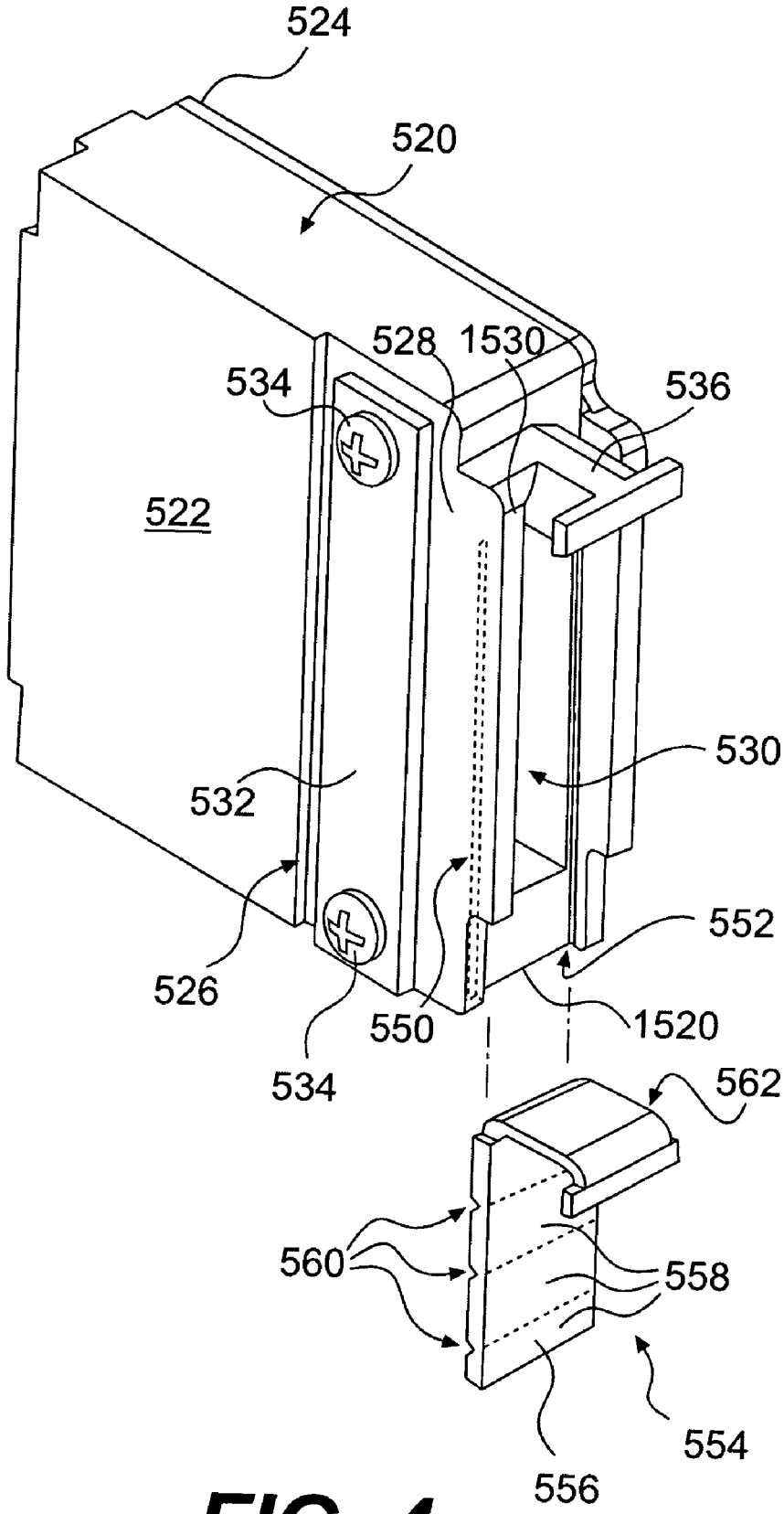
FIG. 4 is a bottom perspective view of another exemplary electrical connector backshell assembly in accordance with various aspects of the disclosure.
Figure 5:
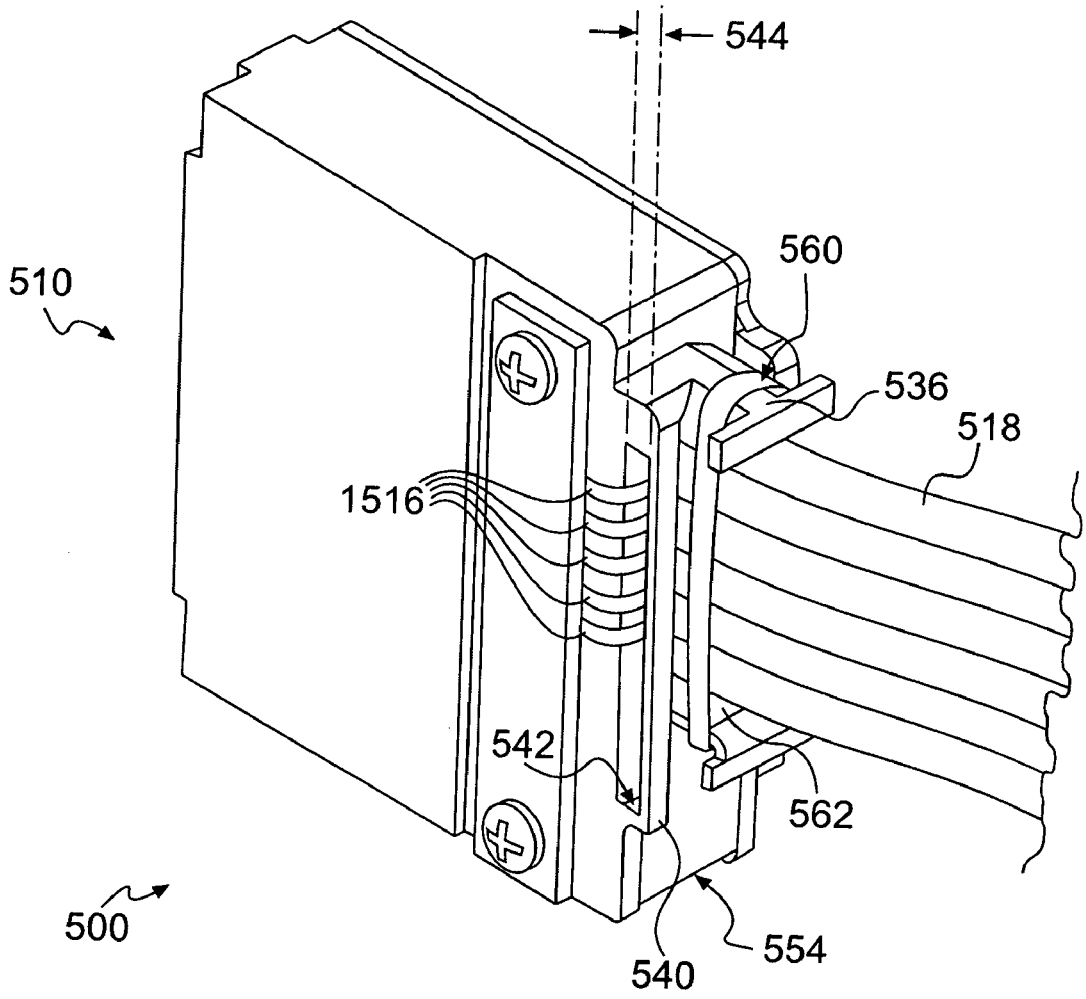
FIG. 5 is a bottom perspective view of the electrical connector backshell assembly of FIG. 4 with a plurality of attached cables.

Referring now to FIGS. 4 and 5, according to various aspects, an exemplary electrical connector backshell assembly 500 may comprise a connection portion 510 and a housing 520. The housing 520 may include a first portion 522, for example, a backshell, and a second portion 524, for example, a cover. The second portion 524 may be removably attachable to the first portion 522 via fasteners such as screws or the like (not shown).

The housing 520 may comprise an opening 530 configured to receive at least one cable 518. Each of the cables 518 may contain at least one electrical wire (not shown), which is protected by a shield (not shown), similar to that shown in FIG. 2 above. The at least one cable 518 may pass through the opening 530 to facilitate connection of the at least one electrical wire to the connection portion 510. A strain relief member 536 may extend from the housing 520 at a first end 1530 of the opening 530.

According to various embodiments, the housing 520 may include a pair of slots 550, 552, one at each side of the opening 530. For example, a first slot 550 may be defined by the first portion 522 and the second slot 552 may be defined by the second portion 524. It should be appreciated that the first and second slots 550, 552 may be defined by the same portion of the housing, as long as the slots 550, 552 are arranged at opposite sides of the opening 530. The slots 550, 552 may extend from a first end 1520 of the housing 520 to the strain relief member 536.

The connector backshell assembly 500 further comprises a cover member 554 configured to be slidably received by the first and second slots 550, 552. For example, the cover member 554 may be substantially j-shaped, with the long segment 556 of the "j" being substantially planar. The long segment 556 may be slidably received by the opposed slots 550, 552. The cover member 554 and slots 550, 552 may be arranged such that the cover member 554 can be slidably moved toward the at least one cable 518 and strain relief member 536 to adjust the size of the opening 530. The slidable cover member 554 may thus render the opening 530 a variable-sized opening.

According to various aspects, the long segment 556 may have a thickness substantially the same as the width of the slots 550, 552 such that the segment 556 can be inserted into the slots 550, 552 with a close sliding fit. According to some aspects, the long segment 556 may have a width substantially the same as the distance between the slots 550, 552 (measured between the depths of each slot) such that the segment 556 can be inserted into and retained by the slots 550, 552 in a close sliding fit to reduce gaps that could allow electrical interference to enter the backshell assembly 500.

A transverse segment 562 of the j-shaped cover member 554 may assist in relieving strain from the at least one cable 518. For example, once all of the cables 518 are passed through the opening 530 and connected to the connection portion 510, the cover member 554 may be slid toward the cable(s) 518. According to various aspects, as shown in FIG. 5, the cover member 554 may contact one or more of the cables 518. The cable(s) 518 may be coupled to the strain relief member 536 and the cover member 554 with a bundling member 560, as shown in FIG. 5.

The bundling member 560 may comprise a cord, band, wrap, or the like, as would be understood by one skilled in the art. Coupling the cable(s) 518 to the strain relief member 536 and cover member 554 may reduce strain on one or more of the cables 518, thus reducing the likelihood of the cables detaching from the connection portion 510. The bundling member 560 may also help retain the cover member 554 in the slots 550, 552.

The long segment 556 of the cover member 554 may comprise a plurality of segments 558 delimited by notches 560. Each of the notches 560 provides a weakened region of the long segment 556 that facilitates breakage. Accordingly, after one or more cables 518 are passed through the opening 530 to facilitate connection of the at least one electrical wire to the connection portion 510, the cover member 554 may be inserted into the slots 550, 552 and slidably moved toward the one or more cables 518 to adjust the size of the opening 530 to a desired size. If at least one segment 558 or a portion thereof extends past the first end 1520 of the housing 520, the extending segment(s) or portion can be removed by breaking the long segment 556 at the notch 560 nearest the first end 1520. Thus, the length of the cover member 554 can be customized such that it does not extend past the first end 1520 of the housing 520 or such that a minimum portion of the cover member 554 extends past the first end 1520 of the housing 520.

According to various aspects, a portion 1516 of the shield of one or more of the cables 518 may be separable from the at least one electrical wire. According to various aspects, one or more of the separated portions 1516 may be twisted into a pigtail to provide a more orderly appearance.

The separated portions 1516 of the shields may be routed back out of the opening 530 and to a termination area 526. Although FIGS. 4 and 5 depict the termination area 526 on an exterior surface 528 of the first portion 522, one skilled in the art would understand that the termination area 526 may be on an interior surface of the first portion 522 or on an interior or exterior surface of the second portion 524.

According to various aspects, the electrical connector backshell assembly 500 may further include a clamping member 532. According to various aspects, the clamping member 532 may comprise, for example, a plate. The clamping member 532 may be configured to urge the separated portions 1516 of the shields in electrical contact with the termination area 526. For example, the clamping member 532 may be coupled to the housing 520 with one or more fasteners 534. The one or more fasteners 534 may comprise any screw or the like known in the art.

According to various exemplary aspects, as shown in FIG. 5, the housing 520 may include an extension 540 extending from a first portion 522 of the housing 520. The extension 540 may include an elongated slot 542 configured to receive one or more separated portions 1516 of shield braids.

According to various aspects, the elongated slot 542 may have a width 544 sized greater than the width of a single separated portion 1516 of a shield braid, but less than a combined width of any two separated portions 1516. Consequently, when a plurality of separated portions 1516 are fed through the slot 542, the width 544 of the slot 542 dictates that the separated portions 1516 pass through the slot 542 in a side-by-side manner without overlapping. The separated portions 1516 thus exit the slot 542 in a side-by-side arrangement, which facilitates a similar side-by-side arrangement of the separated portions 1516 at the termination area 526. The clamping member 532 may clamp the separated portions 1516 to the termination area 526 in a substantially side-by-side arrangement, thus maximizing electrical contact between the separated portions 1516 and the termination area 526. It should be appreciated that the width of the single separated portion 1516 may comprise, for example, a diameter of a pigtailed portion having a substantially round cross-section.

It will be apparent to those skilled in the art that various modifications and variations can be made to the electrical connector backshell assemblies of the present invention without departing from the scope of the invention. Other embodiments of the invention will be apparent to those skilled in the art from consideration of the specification and practice of the invention disclosed herein. It is intended that the specification and examples be considered as exemplary only.

What is claimed is:

1. An electrical connector backshell assembly, comprising:

at least one cable having a width and containing at least one electrical wire that is protected by a shield, at least a portion of the shield being separated from the at least one electrical wire;

a housing defining a variable-sized opening configured to receive the at least one cable, the variable-sized opening configure to accommodate at least the width of the at least one cable;

a cover member comprising a substantially planar portion having a plurality of segments delimited by notches, the cover member configured to adjust the variable-sized opening;

a pair of slots on opposite sides of the variable-sized opening, the pair of slots configured to receive the substantially planar portion of the cover member; and a termination area electrically coupled to the housing, wherein the separated portion of the shield is urged into contact with the termination area.

2. The electrical connector backshell assembly of claim 1, wherein the housing comprises an extension, the extension having an elongated slot between the opening and the termination area, the elongated slot configured to receive said separated portion of the shield.

3. The electrical connector backshell assembly of claim 2, wherein the variable-sized opening is configured to receive a plurality of cables, each of the cables containing at least one electrical wire that is protected by a shield, a portion of each of said shields being separable from the electrical wires.

4. The electrical connector backshell assembly of claim 3, wherein the pair of slots are further configured to receive said separated portions of the shields, and wherein each of the plurality of slots has a width such that the separated portions of the shields are passable through one of the slots in a side-by-side manner without overlapping.

5. The electrical connector backshell assembly of claim 4, further comprising a clamping member configured to urge said separated portions of the shields in contact with the termination area in a side-by-side manner without overlapping.

6. The electrical connector backshell assembly of claim 1, further comprising a clamping member configured to urge said separated portion of the shield in contact with the termination area.

7. The electrical connector backshell assembly of claim 1, further comprising:

a projection extending from the housing next to the variable-sized opening; and a band configured to urge the cover member and the at least one cable toward the projection.

8. The electrical connector backshell assembly of claim 1, wherein one or more segments of the cover member extending beyond the housing are detachable by trimming the cover member at a notch closest to an edge of the housing.

9. An electrical connector backshell assembly, comprising:

a housing defining an opening configured to receive a plurality of cables each containing at least one electrical wire;

a connection portion extending from the housing, the connection portion configured to be electrically coupled with at least one electrical wire of at least one cable and to define an electrical interface to the at least one electrical wire;

a cover member coupled to the housing, the cover member configured to vary the size of the opening to minimize a portion of the opening that is not occupied by at least one cable, the cover member comprising a substantially planar portion having a plurality of segments delimited by notches; and a pair of slots on opposite sides of the opening, the pair of slots configured to slidably receive the substantially planar portion of the cover member.

10. The electrical connector backshell assembly of claim 9, further comprising:

a projection extending from the housing next to the opening; and a band configured to urge the cover member and at least one cable received in the opening toward the projection.

11. The electrical connector backshell assembly of claim 9, wherein a segment of the cover member extending beyond the housing is detachable by trimming the cover member at a notch closest to an edge of the housing.

12. The electrical connector backshell assembly of claim 9, further comprising a termination area electrically coupled to the housing, the termination area configured to receive a clamping member, the clamping member configured to urge a separated portion of a shield of at least one cable received in the opening in contact with the termination area.

13. The electrical connector backshell assembly of claim 12, wherein the housing comprises an extension, the extension having an elongated slot between the opening and the termination area, the elongated slot configured to receive said separated portion of the shield.

14. The electrical connector backshell assembly of claim 13, further comprising:

a plurality of cables passing through the opening, each of the cables containing at least one electrical wire that is protected by a shield, a portion of each of said shields being separable from the electrical wires, wherein the pair of slots are configured to receive said separated portions of the shields and the clamping member is configured to urge said separated portions of the shields in contact with the termination area, and wherein each of the pair of slots has a width such that the separated portions of the shields are passable through such slot in a side-by-side manner without overlapping.

15. The electrical connector backshell assembly of claim 12, further comprising a clamping member configured to urge said separated portion of the shield in contact with the termination area.

16. An electrical connector backshell assembly, comprising:

a housing having a variable-sized opening configured to accommodate a width of at least one cable containing at least one electrical wire;

a connection portion extending from the housing, the connection portion configured to be electrically coupled with the at least one electrical wire and to define an electrical interface to the at least one electrical wire; and a cover member coupled to the housing, the cover member configured to vary the size of the opening to minimize a portion of the opening that is not occupied by the at least one cable, wherein the cover member comprises a substantially planar portion having a plurality of segments delimited by notches.

* * * * *

UNITED STATES PATENT AND TRADEMARK OFFICE

CERTIFICATE OF CORRECTION

PATENT NO. : 7,210,964 B2
APPLICATION NO. : 11/203103
DATED : May 1, 2007
INVENTOR(S) : Brian S. Morris et al.

It is certified that error appears in the above-identified patent and that said Letters Patent is hereby corrected as shown below:

Title page, item [75] inventor: "Robert D. Lanning" should be changed to --Richard D. Lanning--.

Signed and Sealed this

Fourth Day of December, 2007

JON W. DUDAS
*Director of the United States Patent and Trademark Office*